United States Patent [19]

Wallace

[11] 4,066,135

[45] Jan. 3, 1978

[54] TELESCOPIC ROCK DRILL MOUNTING

[75] Inventor: Trevor Evelyn Wallace, Sandton, Transvaal, South Africa

[73] Assignee: The Steel Engineering Company, Roodepoort, Transvaal, South Africa

[21] Appl. No.: 653,894

[22] Filed: Jan. 30, 1976

[51] Int. Cl.[2] ..... E21C 5/00

[52] U.S. Cl. ..... 173/44; 137/625.24

[58] Field of Search ..... 173/43, 44; 137/625.24, 137/625.22; 91/470

[56] References Cited

U.S. PATENT DOCUMENTS

| | | | |
|---|---|---|---|
| 1,446,547 | 2/1923 | Crowe | 91/470 |
| 1,465,568 | 8/1923 | Taylor | 137/625.24 |
| 2,103,252 | 12/1937 | Gartin | 91/470 |
| 2,202,216 | 5/1940 | Madsen | 91/470 |
| 3,036,599 | 5/1962 | Doerfler | 137/625.24 |
| 3,171,436 | 3/1965 | Lowell | 137/625.22 |
| 3,185,222 | 5/1965 | O'Leary | 173/44 |

*Primary Examiner*—Robert A. Hafer
*Attorney, Agent, or Firm*—Young & Thompson

[57] ABSTRACT

A known triangular rock drill mounting comprising a drill feed leg pivoted to a vertical support with an adjustable counterbalancing arm is modified. The counterbalancing arm is a piston and cylinder fed with compressed air. The admission of compressed air is controlled by a valve with an actuating handle. The valve is so constructed that when a given triangular configuration is reached, constant pressure is restored in the cylinder by means of negative feed-back.

13 Claims, 5 Drawing Figures

TELESCOPIC ROCK DRILL MOUNTING

Figure 1:
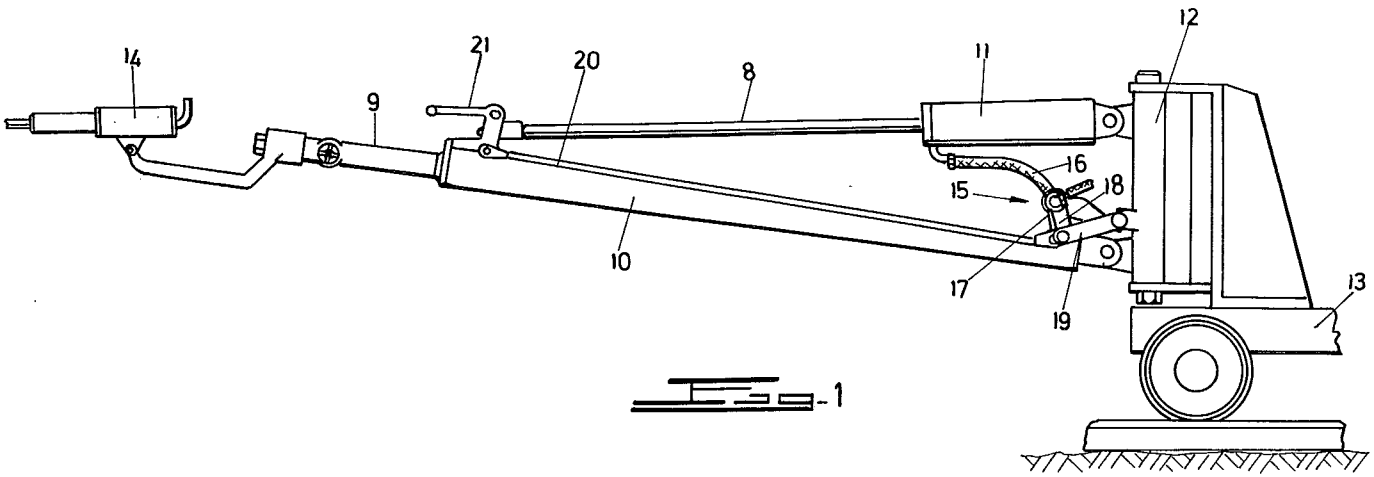

This invention relates to a telescopic rock drill mounting.

An extendable and retractable rock drill mounting of the kind here in question has already been proposed — see U.S. Pat. No. 3,185,222. In the latter proposal the mounting comprises an extendable drill feed leg having a rod telescoping into a feed leg cylinder. The rod carries the rock drill at its free end and the free end of the cylinder is pivoted to a vertical support. A counterbalancing arm forms a triangle with the vertical support and the feed leg cylinder. The counterbalancing arm is adjustable in length and comprises a piston rod and an air cylinder. Constant pressure compressed air introduced into the cylinder provides the counterbalancing force. The shape of the triangle is adjusted manually and the compressed air is intended to maintain any adjusted shape.

However any adjusted shape is in a state of unstable equilibrium. Any force exerted upwardly or downwardly causes the rock drill to continue to move in that direction unless checked either by hand or by actuating the control to the feed of the counterbalancing arm cylinder. Also when the drill feed leg is at an angle to the horizontal, the rock drill tends to be pushed off line and the only way to counteract this is by brute force or by actuating the same control. The latter correction method leads to an unstable condition when the feed leg cylinder thrust alters.

An object of the invention is to provide a device of the kind in question which in any adjusted configuration is in a state of substantially stable equilibrium during use.

According to the invention an extendable and retractable rock drill mounting comprises an extendable drill feed leg having a first element and a second element with one end engaged with and movable along the first element and adapted to carry a rock drill at its free end, a vertical support to which the first element is pivoted at its free end, and a counterbalancing arm forming a triangle with the support of the first element, the counterbalancing arm being adjustable in length, means for providing a thrust to maintain the counterbalancing arm in any adjusted position, means for altering the thrust to adjust the length of the counterbalancing arm and, feedback means so to alter the thrust as to maintain the length of the arm substantially constant in any adjusted configuration.

Further according to the invention an extendable and retractable rock drill mounting comprising an extendable drill feed leg having a cylinder and a piston rod with a piston movable in the cylinder and adapted to carry a rock drill at its free end, a vertical support to which the cylinder is pivoted at its closed end, and a counterbalancing arm forming a triangle with the vertical support and the cylinder, the counterbalancing arm comprising a piston rod, piston and cylinder assembly, adjustable in length, pressure fluid supply means, means to control the admission of fluid to the counterbalancing arm cylinder to adjust the length of the arm and to keep it in any adjusted position, and feed-back means so to alter the admission of pressure fluid to the counterbalancing arm cylinder as to maintain the length of the arm substantially constant in any adjusted configuration.

The invention also comprises a valve comprising a member adapted to be fixed, first and second members adapted to move relatively to one another and the fixed member, an inlet port, an outlet port, an exhaust port, and a handle for moving the first movable member, the first movable member being movable to connect the outlet port to the exhaust port and the inlet port in turn, the second movable member being movable to restore the valve to a position in which the outlet port is between the exhaust port and the inlet port while the first movable member is stationary relatively to the fixed member.

Figure 2:
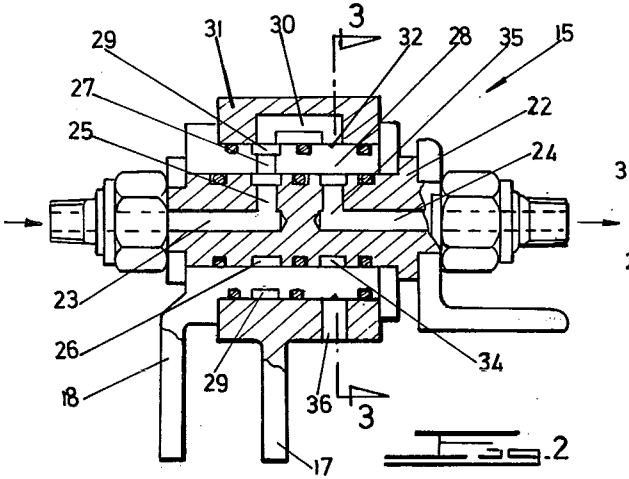
Figure 3:
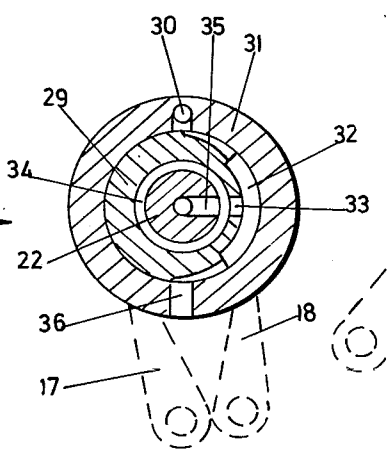
Figure 4:
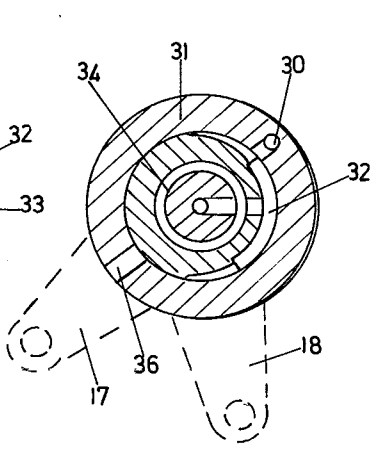
Figure 5:
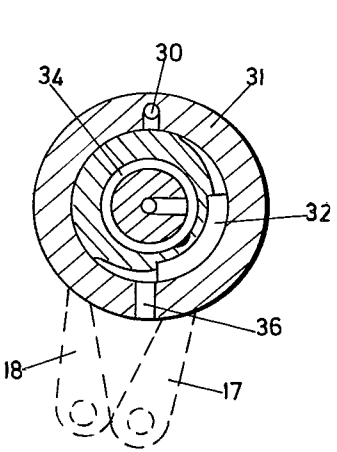

The invention is further discussed with reference to the accompanying drawings, in which FIG. 1 is a side view illustrating a rock drill mounting, FIG. 2 is a longitudinal section through a valve, and FIGS. 3 to 5 are sections along the line 3—3 in FIG. 2 showing the valve parts in various operating positions with certain additional structure in ghost lines.

The general layout of a rock drill mounting is shown in FIG. 1. The known elements comprise an air cylinder 10 with a rod 9 carrying a rock drill 14, a balance cylinder 11 with a rod 8, and a vertical support 12, in this case carried on a truck 13. The cylinders 11 and 10 are pivoted to the support 12 while the rod 8 is connected to the forward end of the cylinder 10. Thus a triangle composed of the support 12 as the first leg, the cylinder 10 as the second leg and the cylinder 11 and the rod 8 (together forming the counterbalancing arm) is constituted. The shape of the triangle may be changed by changing the length of the counterbalancing arm. In use air is supplied to the forward end of the cylinder 11 at constant pressure so that the shape of the triangle is maintained.

As operated before the present invention the shape of the triangle was altered by manually moving the rock drill 14 up or down, or by operating a control valve feeding the cylinder 11.

The improvement provided by the present invention comprises a valve 15 inserted in the supply line 16 to the balance cylinder 11. The valve has two operating arms 17 and 18. The arm 18 is pivotally connected to a link 19 which in turn is pivoted on the support 12. The arm 17 is connected by means of a pivoted connecting rod 20 to an operating lever 21 so that on moving the lever 21 in either direction about its fulcrum the arm 17 moves about the axis of the valve 15.

The valve 15 is illustrated in greater detail in FIG. 2. It has a fixed spindle 22 with a blind axial bore 23 serving as an inlet and a similar bore 24 serving as an outlet. A radial bore 25 connects the bore 23 to an annular groove 26. A radial bore 27 in a sleeve 28 surrounding the spindle 22 is always in communication with the groove 26. The bore 27 communicates with a groove 29 in the periphery of the sleeve 28. An axial bore 30 in a second sleeve 31 ports at one end in the groove 29.

In the result in all relative positions of the spindle 22, the sleeve 28 and the sleeve 31 live air is always present in the bore 30.

The other end of the bore 30 ports in the path of a graduated groove 32 in the periphery of the sleeve 28. A transverse bore 33 from the groove 32 connects with an annular groove 34 on the periphery of the spindle 22. The groove 32 may be seen in FIGS. 3 to 5 in which the position of the arms 17 and 18 in any given valve setting is shown in ghost lines for the sake of a clearer understanding. A further radial bore 35 connects the groove 34 with the bore 24 and hence to the outlet of the valve and the inlet to the cylinder 11.

The result is that the bore 24 is always in communication with the central part of the groove 32 within the limits of movement of the various parts.

The sleeve 31 has a radial bore 36 which also ports on the path of the graduated groove 32 and serves as an exhaust. Note that the groove 32 is graduated at both ends.

The sleeve 31 is connected to the arm 17 and moves with it. Hence it is operated by the lever 21. The sleeve 28 is connected to the arm 18 and through the link 19 to the support 12.

For practical purposes one can consider the bore 30 connected to live air, the centre of the groove 32 to the inlet to the cylinder 11 and the bore 36 to exhaust. If the groove 32 connects solely to the bore 30 and not to the exhaust 36 increased air pressure acts in the cylinder 11 and the cylinder leg contracts. If the bore 32 on the other hand connects solely to the exhaust 36 and not to the bore 30, there is a decrease in the pressure acting in the cylinder 11 and the cylinder leg can expand under the self-weight of the structure. In an equilibrium position (illustrated in FIG. 3) the bore 30 and the exhaust 36 are each at the end of a graduated bore. There is thus a slight leak to atmosphere but constant pressure in the cylinder 11 which therefore remains balanced.

If one wants to lift the rock drill, one moves the lever 21 upwards to move the arm 17 and hence the sleeve 31 to the position shown in FIG. 4. The cylinder leg thus contracts. On the other hand if one seeks to lower the rock drill, one depresses the lever 21 and the cylinder leg can expand under the weight of the structure.

Expansion or contraction of the counterbalancing leg alters the geometry of the triangular configuration and through the link 19 and the arm 18 the relative position of the valve parts is restored to the FIG. 3 configuration which is the configuration of balance. Small movements of the lever 21 lead to small changes and, due to the use of a graduated groove 32, the movements are relatively smooth.

The link 19 and the arm 18 are so chosen and positioned that they move in simultaneously with the cylinder 11 and thus allow the movements described above. The lever 21 is not biased in any way, but the inherent stiffness in the system is such that the lever 21 remains in any position to which it is moved. In operation if it is moved, be it ever so slightly, the angularity of the cylinder 11 changes as a result and as a result of that change of angularity the arm 18 moves the valve sleeve 28 back to the position of equilibrium.

The valve 15 thus ensures that an operation of the lever 21 there is feed-back to achieve the position of equilibrium.

If an existing configuration is acted upon by a force tending to change the configuration, the link 19 and the arm 18 move the sleeve 28 to alter the pressure in the bore 24, thus limiting the deformation of the existing configuration by that force.

The embodiment described above is pneumatic. Other pressure fluids may also be used but in this case the exhaust 36 would lead to a sump. Alternatively electrical actuating devices could be used in place of the cylinder 11 and electrical control devices could replace the valve 15 described above to give feed-back.

I claim:

1. An extendable and retractable rock drill mounting comprising an extendable drill feed leg having a first element, and a second element with one end movable along the length of the first element and adapted to carry a rock drill at its free end, a vertical support to which the first element is pivoted at its free end, and a counterbalancing arm forming a triangle with the vertical support and the first element, the counterbalancing arm being adjustable in length, means for providing a thrust to maintain the counterbalancing arm in any adjusted position, means for altering the thrust to adjust the length of the counterbalancing arm and feed-back means so to alter the thrust as to maintain the length of the arm substantially constant in any adjusted configuration.

2. The rock drill mounting claimed in claim 1 in which the counterbalancing arm comprises a piston and a cylinder fed from a fluid supply, and the means for altering the thrust is a pressure fluid control valve arranged to provide feed-back and comprising a handle for operating the valve.

3. The rock drill mounting claimed in claim 2 in which the valve has a constant bleed to exhaust and a constant feed from the supply in the normal operating position and in which the pressure fluid feed is increased by moving a valve member to close off the exhaust and increase the supply, while the feed is decreased by moving a member to open the exhaust to a larger extent and decrease the amount of pressure fluid fed to the valve.

4. A rock drill mounting claimed in claim 2 in which the valve has an inlet port, an outlet port feeding the cylinder, an exhaust port, a first valve member movable to connect the outlet port to the exhaust port and the inlet port in turn, a second valve member moving simultaneously with the cylinder to restore the valve to a normal position in which the outlet port is connected between the exhaust port and the outlet port so that constant pressure is maintained in the cylinder, and a handle connected to the first member.

5. The rock drill mounting claimed in claim 4 in which in the normal position the outlet port communicates with the inlet port and the exhaust port through graduated grooves allowing a constant bleed through the exhaust port and a constant feed through the inlet port.

6. An extendable and retractable rock drill mounting comprising an extendable drill feed leg having a cylinder and a piston rod with a piston movable in the cylinder and adapted to carry a rock drill at its free end, a vertical support to which the cylinder is pivoted at its closed end, and a counterbalancing arm forming a triangle with the vertical support and the cylinder, the counterbalancing arm comprising a piston rod, piston and cylinder assembly adjustable in length, pressure fluid supply means, means to control the admission of fluid to the counterbalancing arm cylinder to adjust the length of the arm and to keep it in any adjusted position, and feed-back means so to alter the admission of pressure fluid to the counterbalancing arm cylinder as to maintain the length of the arm substantially constant in any adjusted configuration.

7. The rock drill mounting claimed in claim 6 in which the control means is a valve and the valve has an operating handle.

8. The rock drill mounting claimed in claim 7 in which the valve has an inlet port, an outlet port feeding the balancing arm cylinder, an exhaust port, a first valve member movable to connect the outlet port to the exhaust port and the outlet port in turn, and a second valve member connected to move in phase with the balancing arm cylinder to restore the valve to a normal position in which the outlet port is connected between the exhaust port and the inlet port so that a constant pressure is maintained in the balancing arm cylinder, and in which the handle is connected to the first member.

9. The rock drill mounting claimed in claim 5 in which in the normal position the outlet port communicates with the inlet port and the exhaust port through a groove graduated at both ends thus allowing a constant bleed through the exhaust port and a constant feed through the inlet port.

10. For use on an extendable and retractable rock-drill mounting a valve comprising a member adapted to be fixed, first and second members adapted to move relatively to one another and the fixed member, an inlet port, an outlet port, an exhaust port, and a handle for moving the first movable member, the first movable member being movable to connect the outlet port to the exhaust port and the inlet port in turn, the second movable member being movable to restore the valve to a position in which the outlet port is between the exhaust port and the inlet port while the first movable member is stationary relatively to the fixed member.

11. The valve claimed in claim 10 in which the fixed member is a spindle, the second movable member is a sleeve concentric with and journalled to the spindle and the first movable member is a sleeve concentric with the second movable member and journalled to that member.

12. The valve claimed in claim 11 in which the inlet port is at the interface between the first and second movable members at the end of a passage leading from one end of the spindle through the thickness of the first movable member, the passage in the thickness of the second movable member, the exhaust port is also at the same interface at the end of a passage leading through the thickness of the first movable member, the outlet port is at the interface between the first and second movable members, includes a transfer passage extending along the periphery of the second movable member to either side of the outlet port, and leads to a passage along the axis of the spindle, the inlet port and the exhaust port both being positioned to register with the transfer passage at predetermined positions of the first and second movable members about the axis of the spindle.

13. The valve claimed in claim 12 in which the transfer passage has graduated ends.

* * * * *